US010486925B2

(12) United States Patent
Dunn et al.

(10) Patent No.: US 10,486,925 B2
(45) Date of Patent: Nov. 26, 2019

(54) CASSETTE FOR DISPENSING PLEATED TUBING

(71) Applicants: Steven Bryan Dunn, Beverly Hills, CA (US); Kevin D. Johnson, Tarzana, CA (US)

(72) Inventors: Steven Bryan Dunn, Beverly Hills, CA (US); Kevin D. Johnson, Tarzana, CA (US)

(73) Assignee: Munchkin, LLC, Van Nuys, CA (US)

( * ) Notice: Subject to any disclaimer, the term of this patent is extended or adjusted under 35 U.S.C. 154(b) by 701 days.

(21) Appl. No.: 14/736,192

(22) Filed: Jun. 10, 2015

(65) Prior Publication Data

US 2015/0274464 A1 Oct. 1, 2015

Related U.S. Application Data

(63) Continuation of application No. 13/688,139, filed on Nov. 28, 2012, now Pat. No. 9,085,404, which is a (Continued)

(51) Int. Cl.
*B65F 1/00* (2006.01)
*B65F 1/06* (2006.01)
(Continued)

(52) U.S. Cl.
CPC ..... *B65H 5/28* (2013.01); *B65D 85/04* (2013.01); *B65F 1/0006* (2013.01); *B65F 1/062* (2013.01);
(Continued)

(58) Field of Classification Search
CPC ..... B65H 5/28; B65F 1/0006; B65F 1/062; B65F 2210/1675; B65F 2210/181; B65F 2240/132; B65D 85/04
See application file for complete search history.

(56) References Cited

U.S. PATENT DOCUMENTS 2,671,906 A 11/1952 Potts
2,989,828 A 6/1961 Warp
(Continued)

FOREIGN PATENT DOCUMENTS

CA 2366384 A1 6/2003
CA 2486136 A1 5/2005
(Continued)

OTHER PUBLICATIONS

European Search Report, dated May 25, 2016, pp. 1-7.
(Continued)

*Primary Examiner* — William A. Rivera
(74) *Attorney, Agent, or Firm* — Robert Z. Evora, Esq.

(57) ABSTRACT

A cassette for use in dispensing a pleated tubing. The cassette includes an annular body having a generally U shaped housing with an open central cylindrical core. The annular body includes an inner wall, an angular wall a bottom wall and an outer wall. The annular cover has an outer wall and a ledge that extends radially inward from the outer wall and over the annular body that defines a gap between an inner edge of the ledge and the inner wall of the annular body. An inter-engagement mechanism is provided on the annular body and on opposite edges of the annular cover that cooperates to secure the cover to the body. At least one aperture is provided in the angular wall to enable ventilation of the air.

19 Claims, 12 Drawing Sheets

Related U.S. Application Data continuation of application No. 29/435,445, filed on Oct. 24, 2012, now Pat. No. Des. 695,541.

(51) Int. Cl.
*B65H 5/28* (2006.01)
*B65D 85/04* (2006.01)

(52) U.S. Cl.
CPC . *B65F 2210/1675* (2013.01); *B65F 2210/181* (2013.01); *B65F 2240/132* (2013.01)

(56) References Cited

U.S. PATENT DOCUMENTS

| | | | | |
|---|---|---|---|---|
| 3,152,576 | A | 10/1964 | Faurot | |
| D201,670 | S | 7/1965 | Moore | |
| 3,321,103 | A | 5/1967 | Phillips | |
| 3,376,046 | A | 4/1968 | Kivett et al. | |
| 3,401,409 | A | 9/1968 | Ekrut | |
| 3,452,368 | A | 7/1969 | Couper | |
| 3,536,192 | A | 10/1970 | Couper | |
| 3,602,924 | A | 9/1971 | Kneisley | |
| 3,619,822 | A | 11/1971 | Carmichael | |
| 3,746,159 | A | 7/1973 | May | |
| 3,938,300 | A | 2/1976 | Lovqvist | |
| 3,956,510 | A | 5/1976 | Beall | |
| 4,085,706 | A | 4/1978 | Evans | |
| 4,132,047 | A | 1/1979 | Gerigk et al. | |
| 4,408,692 | A | 10/1983 | Sigel et al. | |
| 4,420,093 | A | 12/1983 | Von Holdt | |
| 4,505,003 | A | 3/1985 | Becker et al. | |
| 4,528,719 | A | 7/1985 | Frey | |
| D279,949 | S | 8/1985 | Rossin | |
| D302,753 | S | 8/1989 | Zelinger | |
| 4,869,049 | A | 9/1989 | Richards et al. | |
| 4,934,529 | A | 6/1990 | Richards et al. | |
| 5,045,020 | A | 9/1991 | Neeff et al. | |
| 5,046,219 | A | 9/1991 | Stanley | |
| 5,056,293 | A | 10/1991 | Richard et al. | |
| D321,572 | S | 11/1991 | Laden | |
| 5,230,651 | A | 7/1993 | Farkonas et al. | |
| D351,606 | S | 10/1994 | Markusson et al. | |
| 5,535,913 | A | 7/1996 | Asbach et al. | |
| 5,590,512 | A | 1/1997 | Richards et al. | |
| D381,472 | S | 7/1997 | Catalano et al. | |
| 5,699,925 | A | 12/1997 | Petruzzi | |
| 5,813,200 | A | 9/1998 | Jacoby et al. | |
| 6,065,272 | A | 5/2000 | Lecomte | |
| 6,170,240 | B1 | 1/2001 | Jacoby et al. | |
| 6,370,847 | B1 | 4/2002 | Jensen et al. | |
| 6,612,099 | B2 | 9/2003 | Stravitz et al. | |
| 6,925,781 | B1 | 8/2005 | Knuth et al. | |
| 6,941,733 | B2 | 9/2005 | Chomik et al. | |
| 6,974,029 | B2 | 12/2005 | Morand et al. | |
| 7,100,767 | B2 | 9/2006 | Chomik et al. | |
| 7,395,646 | B2 | 7/2008 | Salman et al. | |
| D614,897 | S | 5/2010 | Morand et al. | |
| D615,786 | S | 5/2010 | Morand et al. | |
| 7,707,808 | B2 | 5/2010 | Chomik et al. | |
| 7,743,588 | B2 * | 6/2010 | Webb | B65F 1/062 220/495.06 |
| 7,757,467 | B2 | 7/2010 | Chomik et al. | |
| 7,931,150 | B2 | 4/2011 | Morand | |
| 8,091,325 | B2 | 1/2012 | Stravitz et al. | |
| 8,440,316 | B2 | 5/2013 | Chomik et al. | |
| 8,484,936 | B2 | 7/2013 | Tannock | |
| 8,899,420 | B2 | 12/2014 | Morand | |
| 9,085,404 | B2 * | 7/2015 | Dunn | B65F 1/062 |
| 2003/0121923 | A1 | 7/2003 | Morand | |
| 2004/0020175 | A1 | 2/2004 | Stravitz | |
| 2004/0217122 | A1 | 11/2004 | Trinko et al. | |
| 2005/0016890 | A1 * | 1/2005 | Tannock | B65B 9/18 206/497 |
| 2006/0130439 | A1 | 6/2006 | Stravitz | |
| 2008/0272140 | A1 * | 11/2008 | Mowers | B65F 1/062 221/69 |
| 2009/0100806 | A1 * | 4/2009 | Morand | B65B 67/1277 53/567 |
| 2011/0000172 | A1 | 1/2011 | Morand | |
| 2012/0080352 | A1 | 4/2012 | Morand | |
| 2014/0183193 | A1 * | 7/2014 | Hammond | B65F 1/002 220/87.2 |
| 2015/0052858 | A1 | 2/2015 | Morand | |
| 2016/0083182 | A1 * | 3/2016 | Dunn | B65F 1/062 206/409 |
| 2016/0244256 | A1 | 8/2016 | Morand | |
| 2016/0244257 | A1 | 8/2016 | Morand | |
| 2016/0244258 | A1 | 8/2016 | Morand | |

FOREIGN PATENT DOCUMENTS

| | | | | |
|---|---|---|---|---|
| CA | 3030263 | A1 | 4/2009 | |
| CA | 2387183 | C | 5/2009 | |
| CA | 2724805 | A1 * | 11/2009 | B65F 1/062 |
| CA | 2640384 | C | 9/2014 | |
| CA | 2855159 | C | 11/2016 | |
| CA | 2936415 | C | 4/2017 | |
| CA | 2936421 | C | 4/2017 | |
| CA | 2937312 | C | 4/2017 | |
| CA | 2936414 | C | 5/2017 | |
| CA | 2936420 | C | 8/2017 | |
| CA | 2936402 | C | 9/2017 | |
| CA | 2974663 | C | 2/2019 | |
| DE | 9319683 | U1 | 6/1994 | |
| DE | 202005015081 | | 3/2007 | |
| EP | 303517 | A1 | 2/1989 | |
| EP | 699584 | A2 | 6/1996 | |
| EP | 2045197 | A1 | 4/2009 | |
| EP | 2818430 | A1 | 12/2014 | |
| GB | 2221889 | A | 2/1990 | |
| JP | 5429272 | | 3/1979 | |
| JP | 63123701 | A | 5/1988 | |
| JP | 5715322 | B2 | 5/2015 | |
| WO | 199817536 | A1 | 4/1998 | |
| WO | 2005042381 | | 5/2000 | |
| WO | 0220354 | A | 3/2002 | |
| WO | 200220354 | A1 | 3/2002 | |
| WO | 2002020354 | | 3/2002 | |
| WO | 2002100723 | | 12/2002 | |
| WO | 2003059748 | A2 | 7/2003 | |
| WO | 2003068635 | A1 | 8/2003 | |
| WO | 2005/042381 | A2 | 5/2005 | |
| WO | 2009007723 | A | 1/2009 | |
| WO | 20090007723 | | 1/2009 | |
| WO | WO 2009/007723 | | 1/2009 | |

OTHER PUBLICATIONS

International Search Report and Written Opinion for PCT/US2013/029555 dated Jul. 9, 2013 (pp. 1-10).

European Search Report and Written Opinion for EP19158759.1-1017, dated Jun. 14, 2019. (pp. 11).

International Search Report for PCT/GB2008/002360, dated Oct. 10, 2008 (pp. 3).

* cited by examiner

CASSETTE FOR DISPENSING PLEATED TUBING

CROSS REFERENCE TO RELATED APPLICATIONS

This application incorporates and claims the benefit of the filing date of U.S. Non Provisional application Ser. No. 13/688,139, entitled "CASSETTE FOR DISPENSING PLEATED TUBING" filed Nov. 28, 2012, and U.S. Design patent application Ser. No. 29/435,445, entitled "CASSETTE" filed Oct. 24, 2012, the entirety of which is incorporated herein by reference.

TECHNICAL FIELD

The subject disclosure relates to a cassette used for dispensing pleated tubing. More specifically, to a cassette capable of storing a pleated tubing and adapted for use within a disposal container to collect waste refuse.

BACKGROUND

Various refillable cassettes have been provided for the disposal of waste material. Expired U.S. Pat. No. 4,934,529 to Richards et al. is an example of an apparatus applicable to the disposal of waste material. The cassette includes a resilient flexible tubing packed therein and covered by a secured radial cap.

U.S. Pat. No. 6,974,029 to Morand is another example of a conventional film dispensing cassette that requires the use of a tear-off projecting section disposed on its top portion having an outer edge engaging an upper part of the outer wall of the cassette body out of which a pleated tubing is withdrawn in a direction that is different from the Richards et al. reference cited above.

U.S. Pat. No. 7,743,588 to Webb is yet another example of a waste storage cassette device requiring a cassette rotator that is rotatably mounted in an upper part of the container in order to access the tubing stored therein.

Each of these conventional dispensers requires cumbersome techniques overcome by the disclosure below. Despite the ineffectiveness of these conventional attempts to provide a storage cassette, a need exists for a low cost, efficient storage container that can be conveniently assembled.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Particular embodiments of the present invention will now be described in greater detail with reference to the figures.

FIGS. 1-4 illustrate lower and upper perspective and exploded perspective views of an exemplary cassette 10 according to this subject disclosure. The cassette 10 is composed of a lower annular body 20 having a generally U-shaped cross-section compartment and an annular cover 40 that extends over a portion of the U-shaped channel cross-section compartment.

Figure 1:
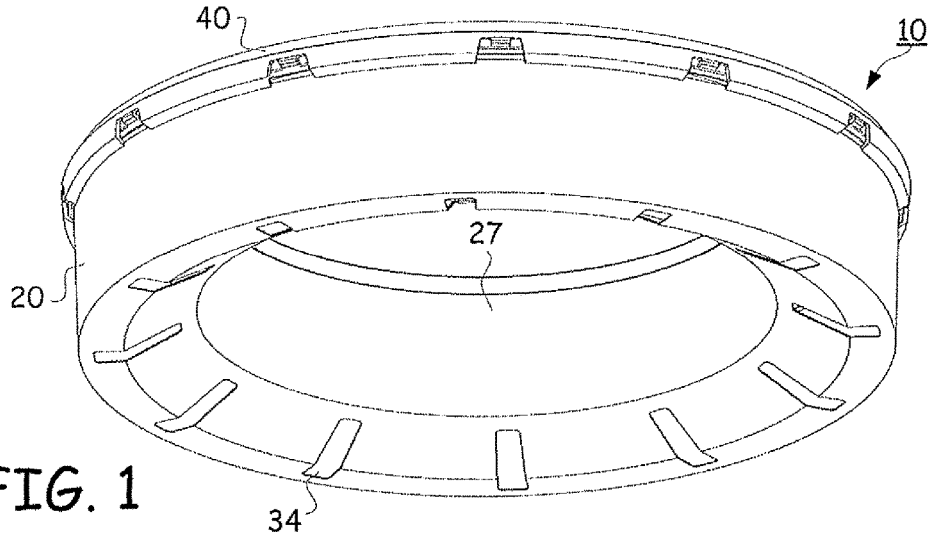
FIG. 1 illustrates a lower perspective view of an exemplary cassette according to the subject disclosure.
Figure 2:
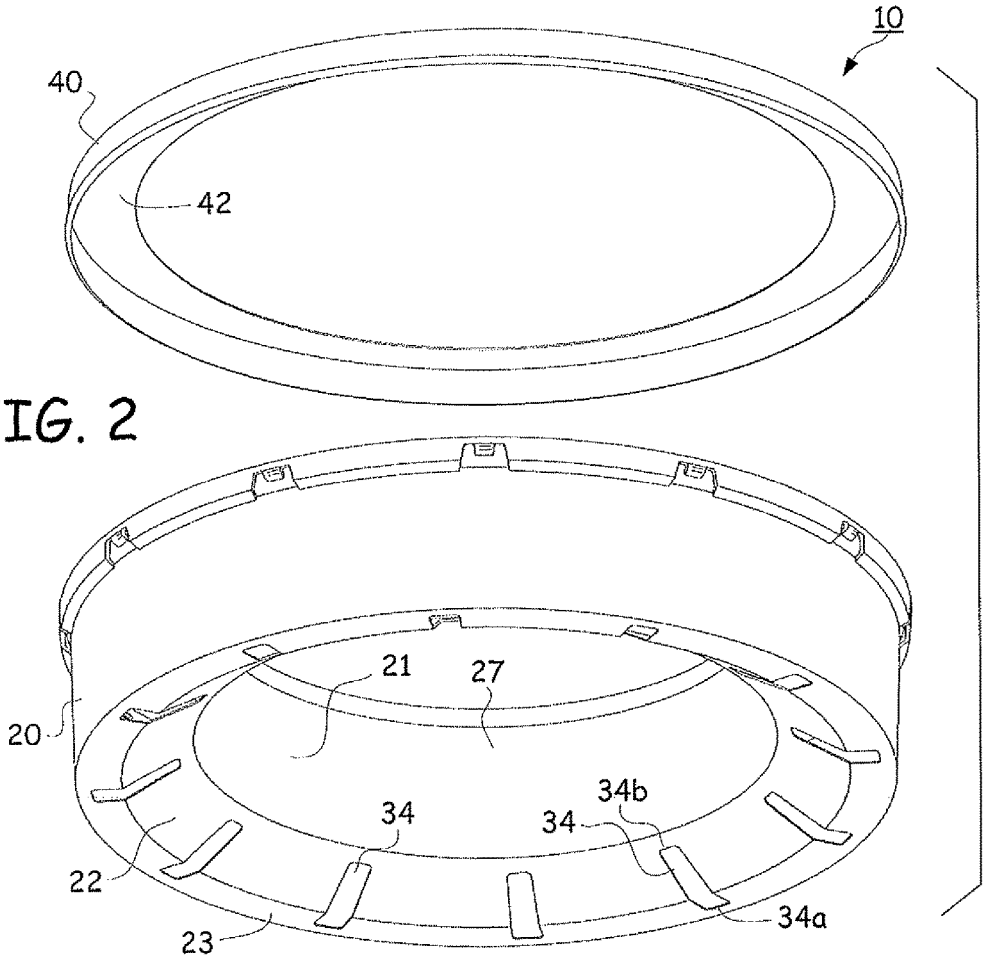
FIG. 2 depicts an exploded lower perspective view of an annular cover and annular body of the cassette according to the subject disclosure.
Figure 3:
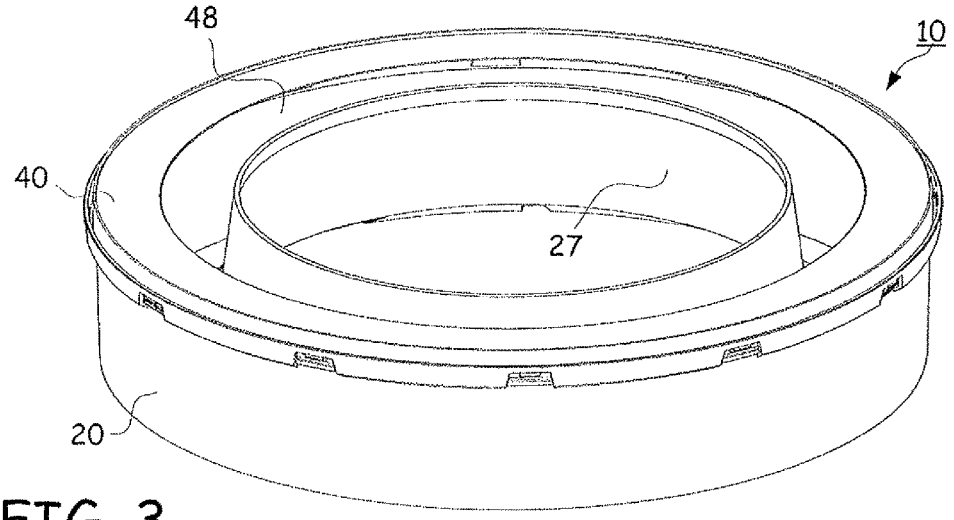
FIG. 3 illustrates an upper perspective view of the cassette.
Figure 4:
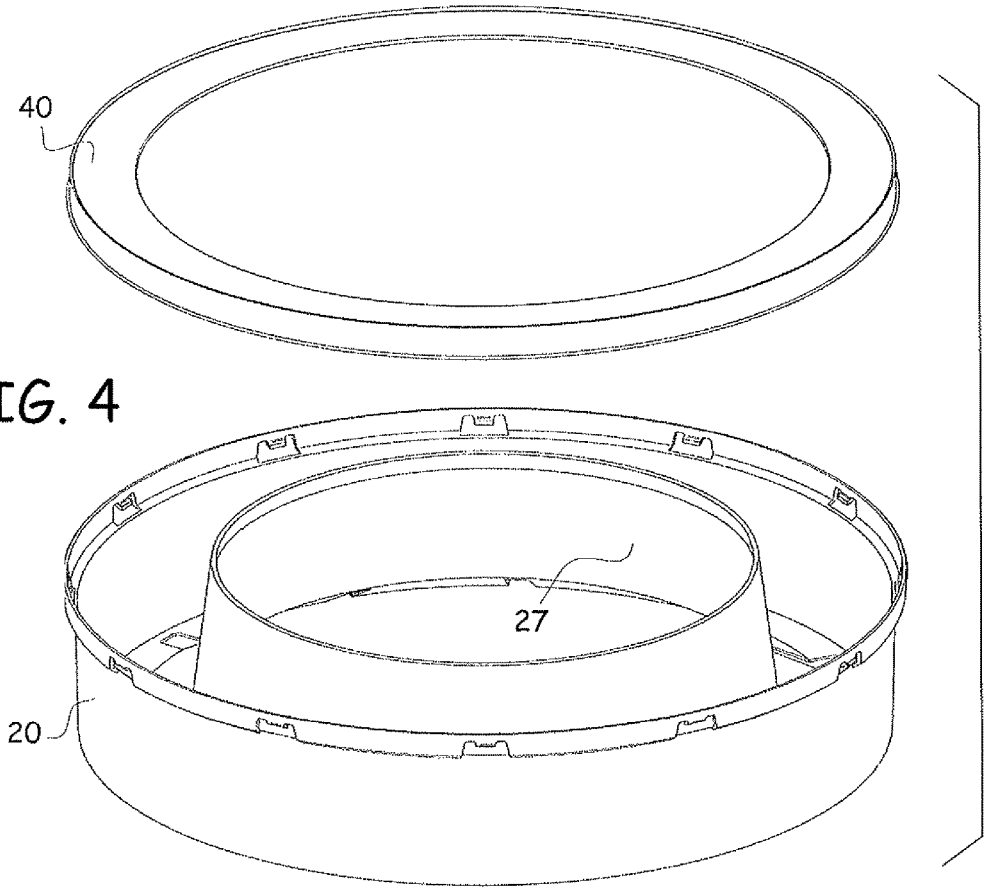
FIG. 4 depicts an exploded upper perspective view of the annular cover and annular body of the cassette.
Figure 5:
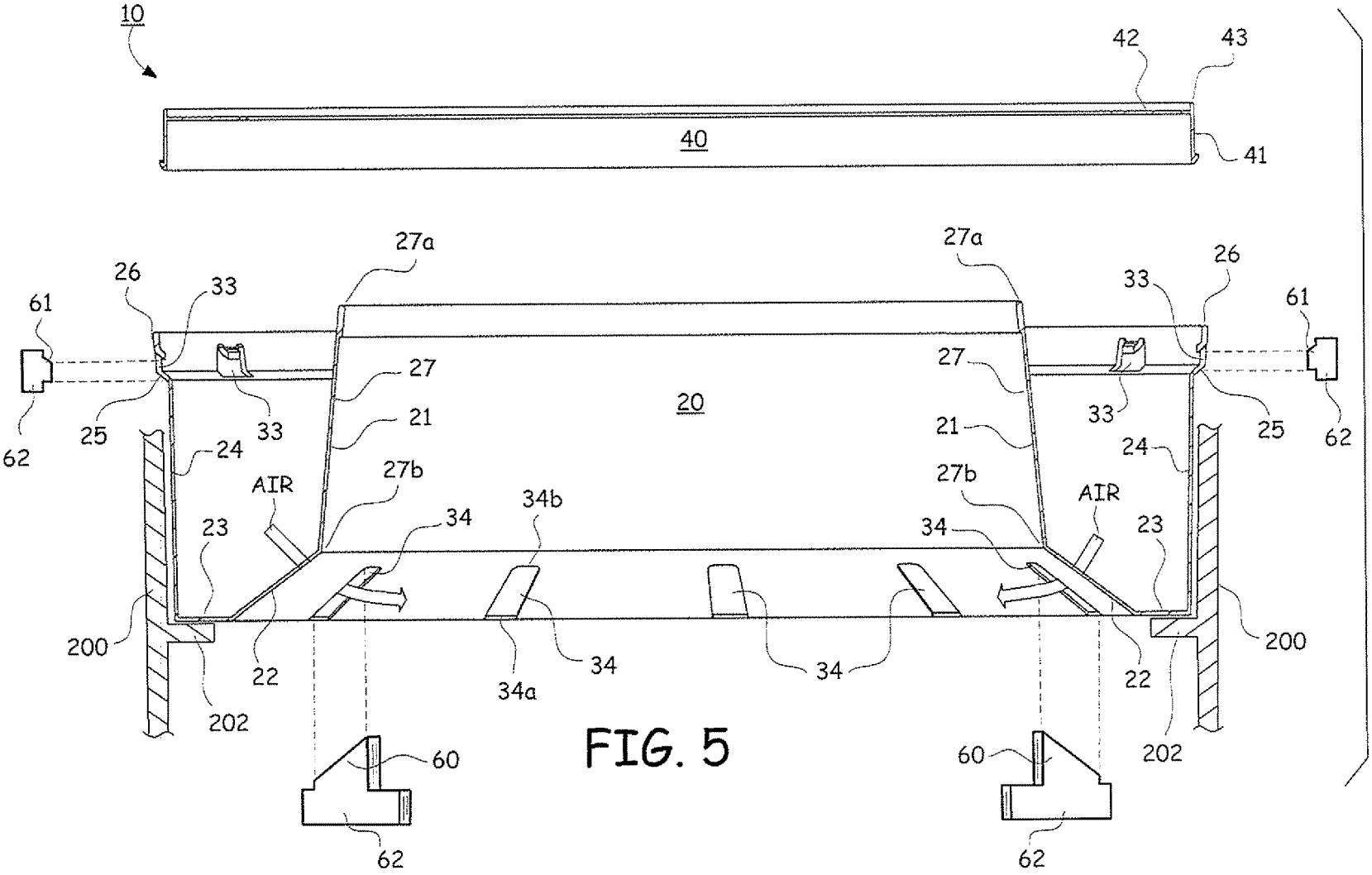
FIG. 5 illustrates an exploded cross section side view of the annular cover and annular body of the cassette disposed in a support.

FIG. 5 depicts an exploded cross section view of the cassette 10. The lower annular body 20 includes an inner wall 21 connected to an angular wall 22. The angular wall 22 is connected to a bottom wall 23, which is connected to an outer wall 24. An outward flared angular wall 25 is provided at an upper end of the outer wall 24. The outward flared angular wall 25 terminates at an upper end into an expanded outer wall 26. The inner wall 21, angular wall 22, bottom wall 23, outer wall 24, outward flared angular wall 25 and the expanded outer wall 26 collectively form the U-shaped channel cross-section of a housing into which a pack 52 of a pleated flexible tubing 50 is received, as shown in FIG. 6.

As shown in FIG. 5, the cassette 10 is held by a support member 200 in use. An extended surface 202 may be provided to extend horizontally from the support member 200 to define a flat shelf or surface onto which the lower wall 23 of the U-shaped annular body 20 may be supported.

Figure 6:
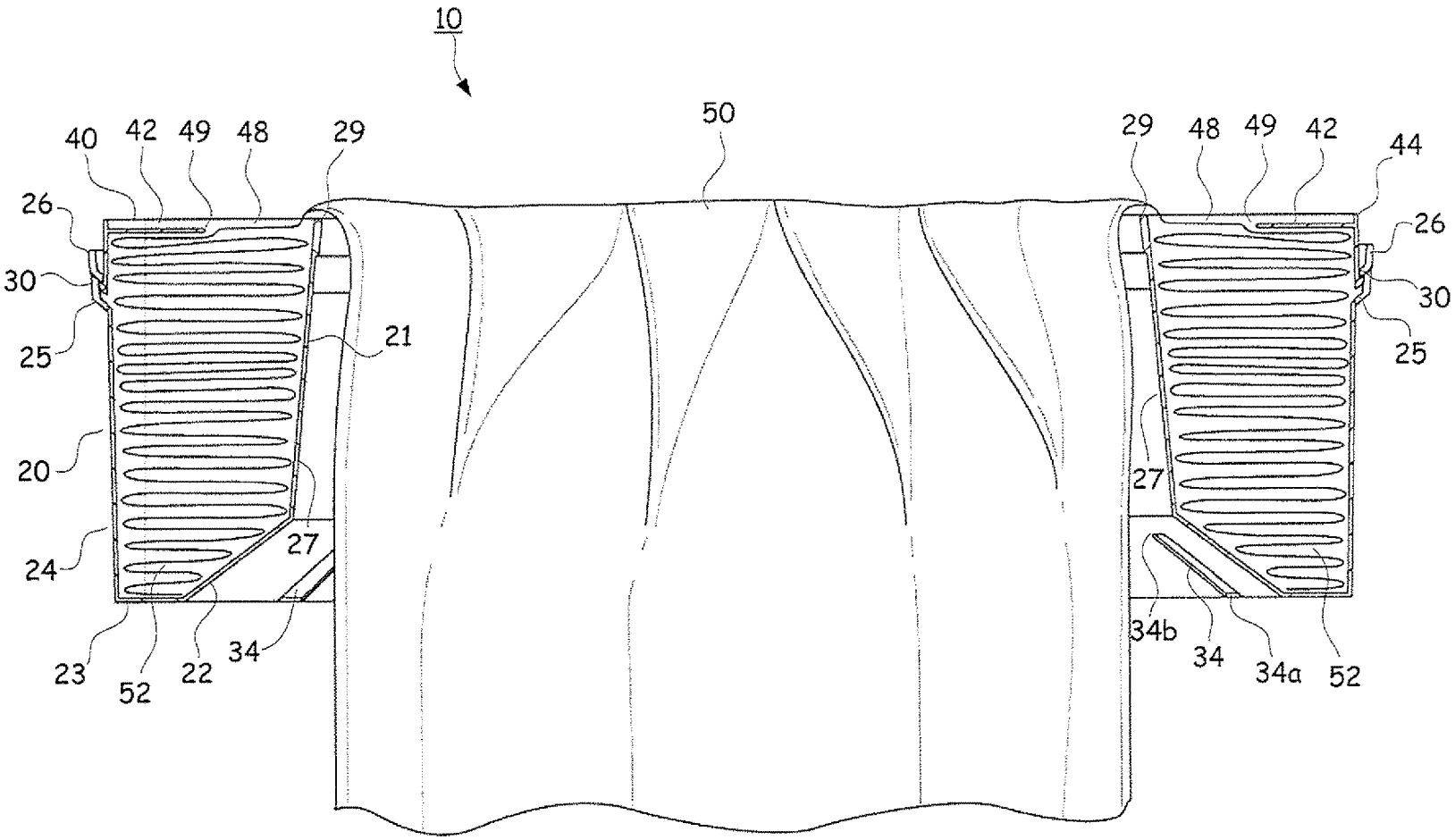
FIG. 6 shows a cross section view of the cassette having a flexible tubing disposed therein.
Figure 8:
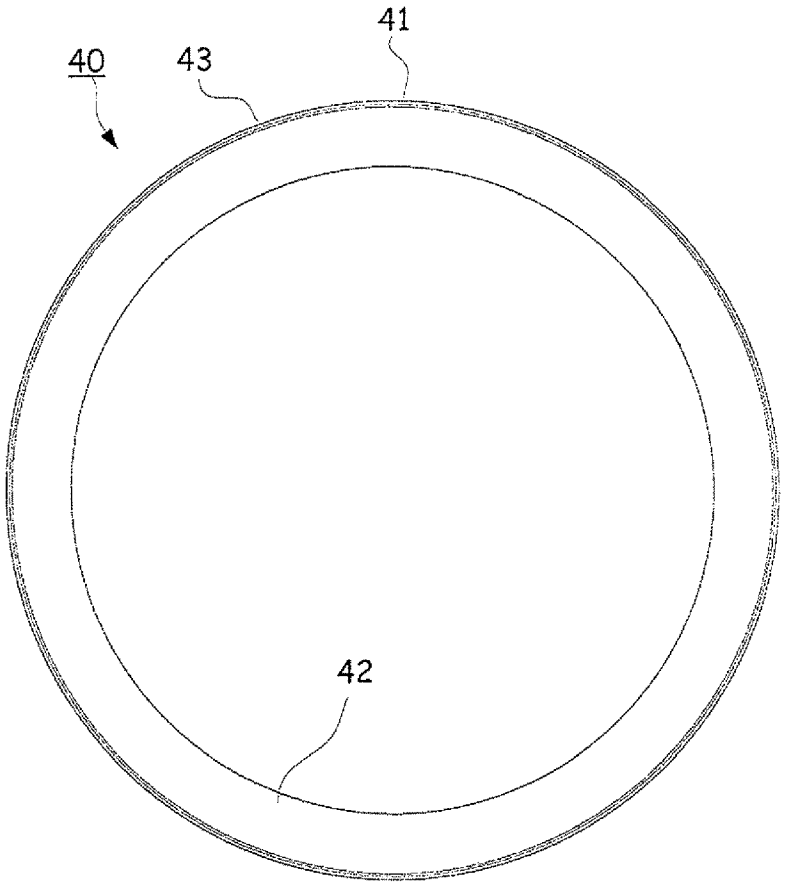
FIG. 8 shows a top view of the annular cover.
Figure 7:
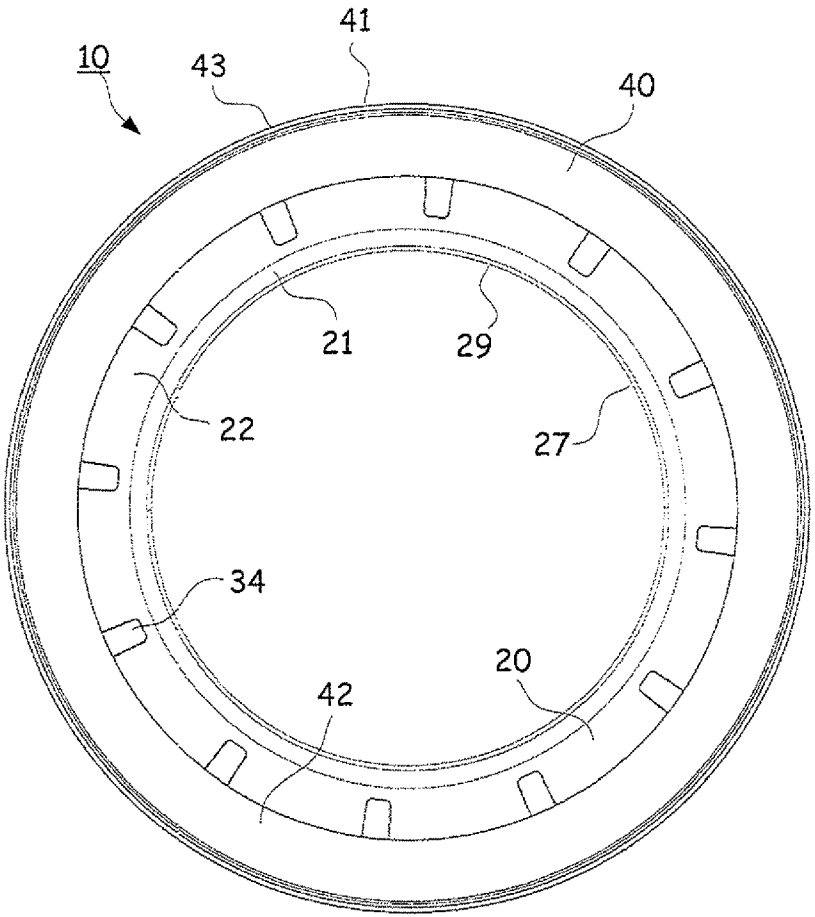
FIG. 7 depicts a top view of the cassette.
Figure 17:
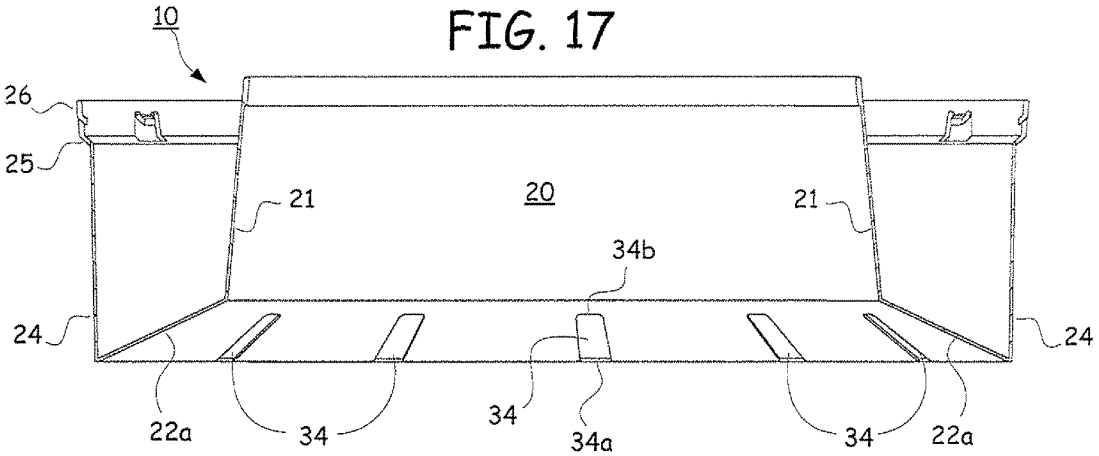
FIG. 17 illustrates an alternative side cross section view of the angular wall configuration of the annular body of the cassette.
Figure 18:
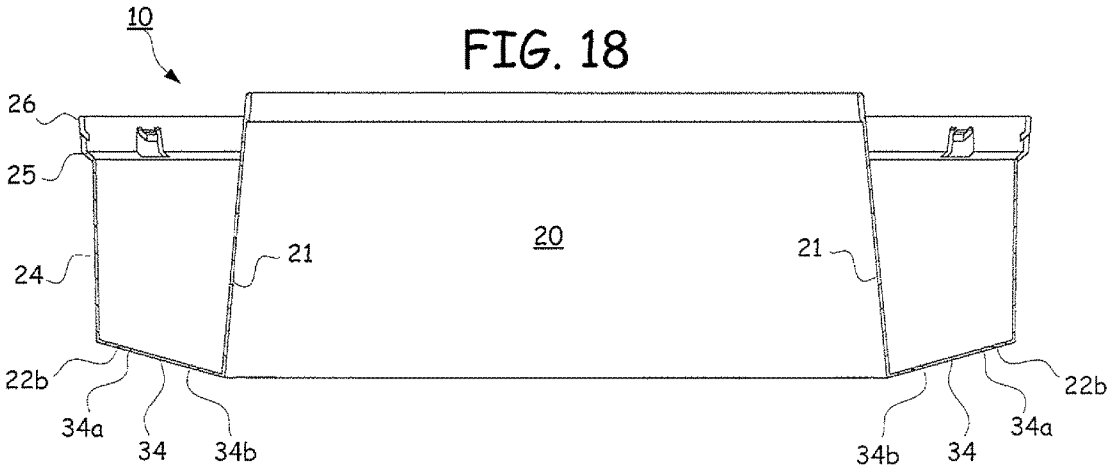
FIG. 18 depicts another alternative side cross section view of the angular wall configuration of the annular body of the cassette.

The lower configuration of the U-shaped channel cross-section and/or the angular configuration taken by the angular wall 22 may take a variety of different suitable angles in order to allow air to escape from below during the packing of the flexible tubing 50 into the lower annular body 20 as a packed tubing 52 as shown in FIG. 6 and described in more detail later. For example, the angular wall may be directly connected between the outer wall 24 and the inner wall 21, without the need for a bottom wall 23 as shown in FIGS. 17-18 and will be explained in more detail below.

Referring to FIG. 5, the U-shaped annular body 20 encircles the central cylindrical core 27. That is, the inner wall 21 of the annular body 20 defines the central cylindrical core 27 opening having a cylindrical open top 27*a* and a cylindrical open bottom 27*b* construction.

As shown in FIG. 6, and described in more detail later, the tubing 50 is shown as a packed tubing 52 disposed in the U-shaped channel cross-section of the lower annular body 20. The packed tubing 52 is adapted to be received and pulled upward from within the U-shaped channel pass the annular cover 40, over an upper edge 29 of the inner wall 21 and downward through the central cylindrical core 27 opening.

As shown in FIG. 5 and particularly FIGS. 9-10, the annular cover 40 has an outer cylindrical wall 41 and an inwardly extending ledge 42 that begins extending slightly below a top edge 43 of the outer cylindrical wall 41 thereby defining a concentric top rim 44 in the annular cover 40. When positioned over the lower annular body 20, the ledge 42 extends from the cylindrical outer wall 41 inward and towards, but not as far as, the inner wall 21 of the central cylindrical core 27 as shown in partial cross section in FIG. 9.

FIGS. 9-12 illustrate the cylindrical outer wall 41 of the annular cover 40 having a lower end 45 that is capable of being received inside of an inner surface 28 (shown in FIG. 10) of the expanded outer wall 26 of the U-shaped channel of the lower annular body 20. In particular, an annular upturned lip 46*a* of a V-shaped groove 46 is formed at a lower end 45 of the outer wall 41 of the annular cover 40. As shown in FIGS. 9-12, the annular V-shaped groove 46 interlocks with a protruding tongue 30 defined in the expanded outer wall 26 and outward flared angular wall 26 of the lower annular body 20.

Figure 9:
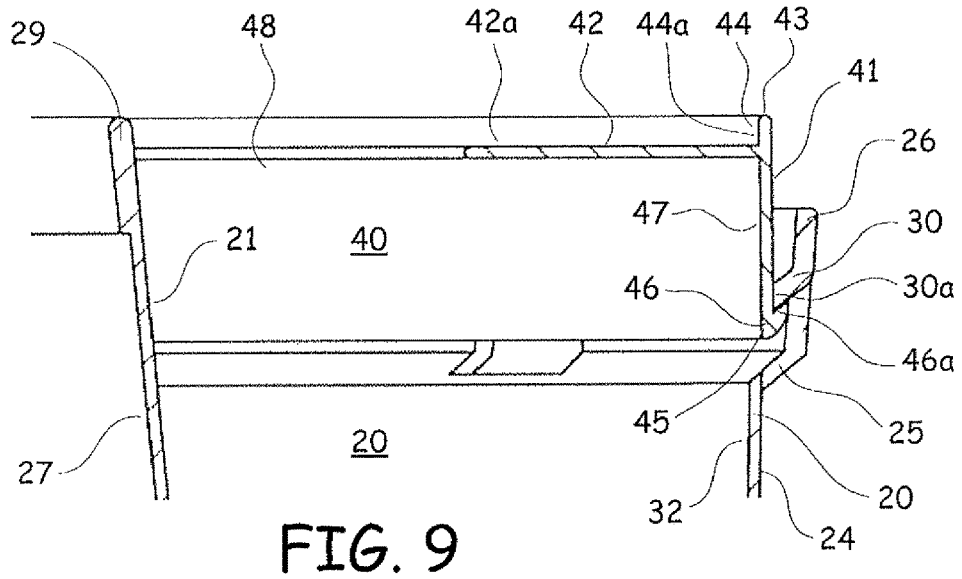
FIG. 9 depicts an partial side cross section view of the annular cover connected to the annular body of the cassette.
Figure 12:
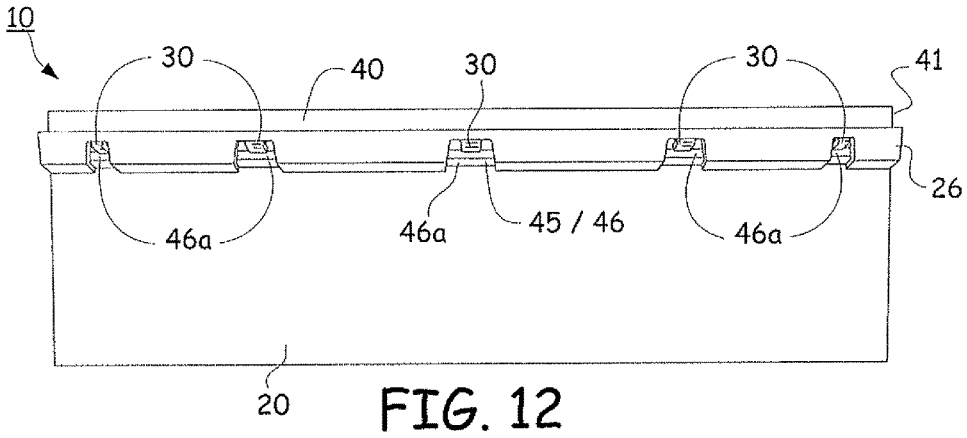
FIG. 12 depicts a side view of the annular cover secured by the tongues onto the annular body of the cassette.

In place, the annular cover 40 and the lower annular body 20 are lockingly engaged to one another as shown in FIGS. 9 and 12. To prevent the annular cover 40 from being disconnected from within the expanded outer wall 26 of the lower annular body 20, the annular cover 40 is lowered and positioned within the upper edge of the expanded outer wall 26 of the annular body 20 so that an outer edge of the upturned lip 46*a* of the annular V-shaped groove 46 slides past a lower edge 30*a* of the protruding tongue 30 as shown in FIGS. 9 and 12.

The upturned lip 46*a* of the annular V-shaped groove 46 is then locked against an outermost edge 30*a* of the protruding tongue 30. The protruding tongue 30 functions as a detent so that the annular cover 40 is mechanically arrested and cannot be undesirably lifted or raised off of the lower annular body 20 after the annular V-shaped groove 46 has been securely mounted against the protruding tongue 30.

Figure 10:
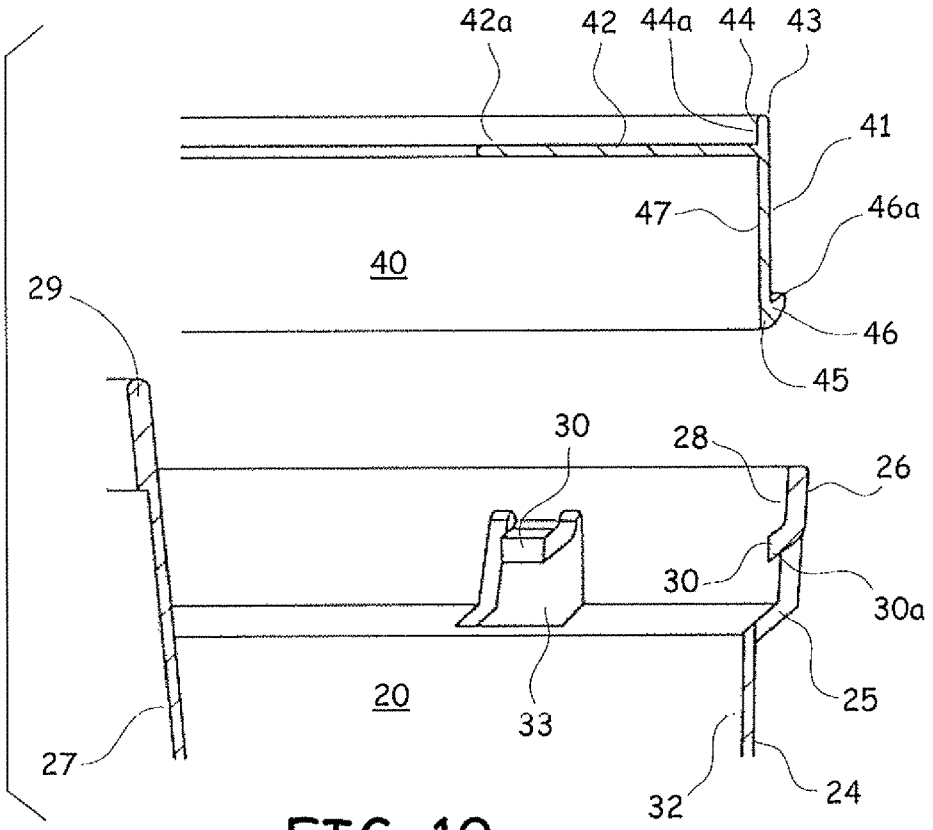
FIG. 10 illustrates an exploded partial side cross section view of the annular cover and annular body of the cassette.
Figure 11:
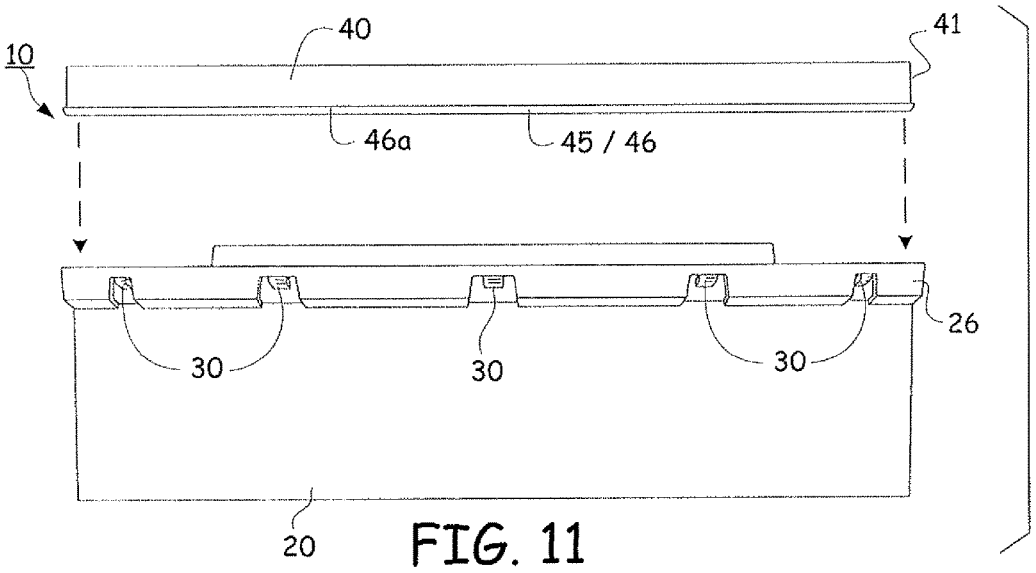
FIG. 11 shows an exploded side view of the annular cover being lowered onto the annular body of the cassette.
Figure 13:
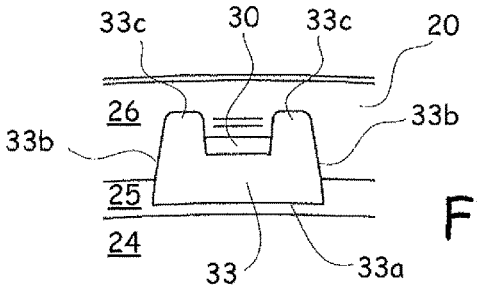
FIG. 13 shows an exploded view of a projecting tongue and surrounding opening around the tongue.

FIGS. 10 and 13 illustrate at least one construction in which the protruding tongues 30 for a cooperating inter-engagement mechanism, such as a detent mechanism can be formed. For example, an opening 33 and the protruding tongues 30 can be formed with a piercing tool (not shown). The protruding tongues 30 may be distributed around the upper casing of the annular body 20 as shown in FIGS. 11-13, before or after installation of the packed tubing 50. FIG. 13 shows that the piercing tool may be used to cut away at the walls of the expanded outer wall 26 and the outward flared angular wall 26 of the annular body 20 to create the opening 33 and the tongues 30 that protrude inwardly around the outer wall 26 of the annular body 20. Any other suitable construction for the opening 33 and the protruding tongues 30 may be formed.

FIG. 13 depicts in more detail, an example in which the protruding tongue 30 includes a surrounding opening 33 defined by a lower edge 33*a*, a pair of side edges 33*b* and upper cut out sections 33*c* on each side of the protruding tongue 30. It is to be understood that various other alternatives and/or constructions may exist for providing a cooperating inter-engagement mechanism that secures the annular cover 40 to the annular body 20. For example, providing mating protrusions on the annular cover 40 that cooperate with protrusions on the annular body 20 to secure the annular cover 40 to the annular body 20. After the associated mating protrusions have passed over each, the annular cover 40 can be locked in place to the annular body 20.

Figure 14:
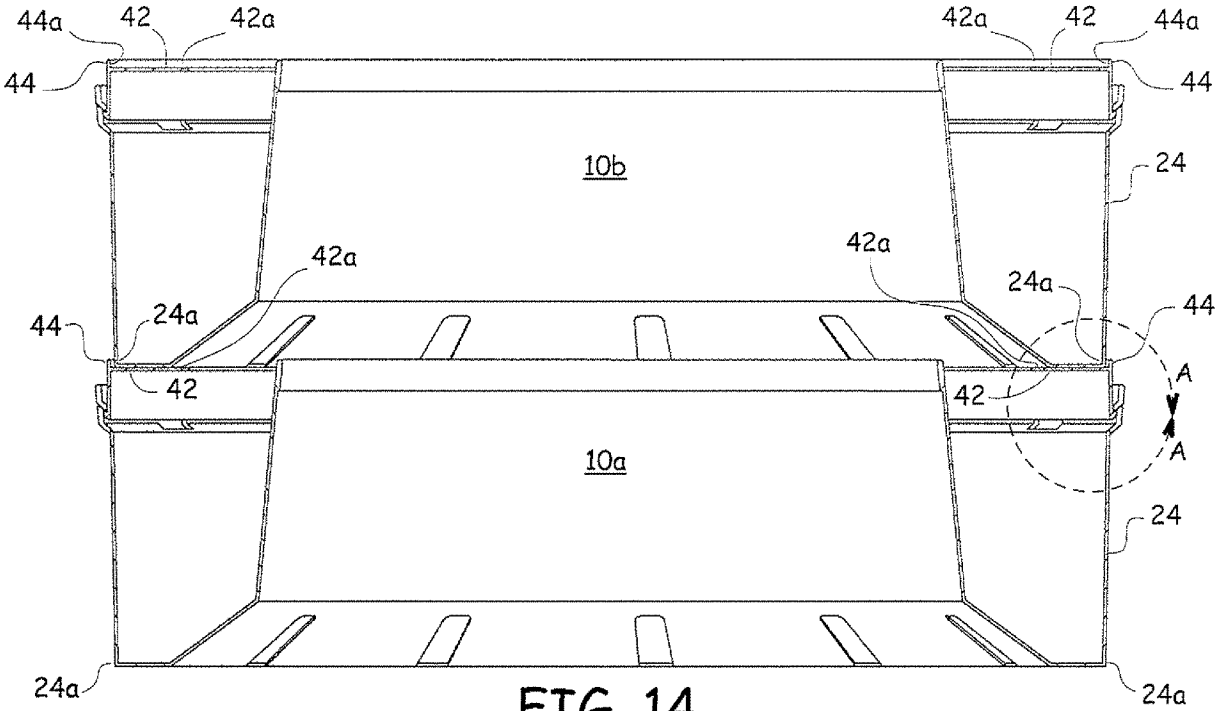
FIG. 14 illustrates a cross section view of a pair of stacked cassettes according to this disclosure.
Figure 15:
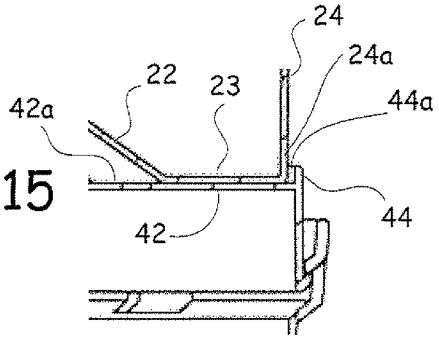
FIG. 15 depicts an enlarged cross section view of the exploded A-A section in FIG. 14 of a concentric lip aligning the pair of stacked cassettes according to this disclosure.
Figure 16:
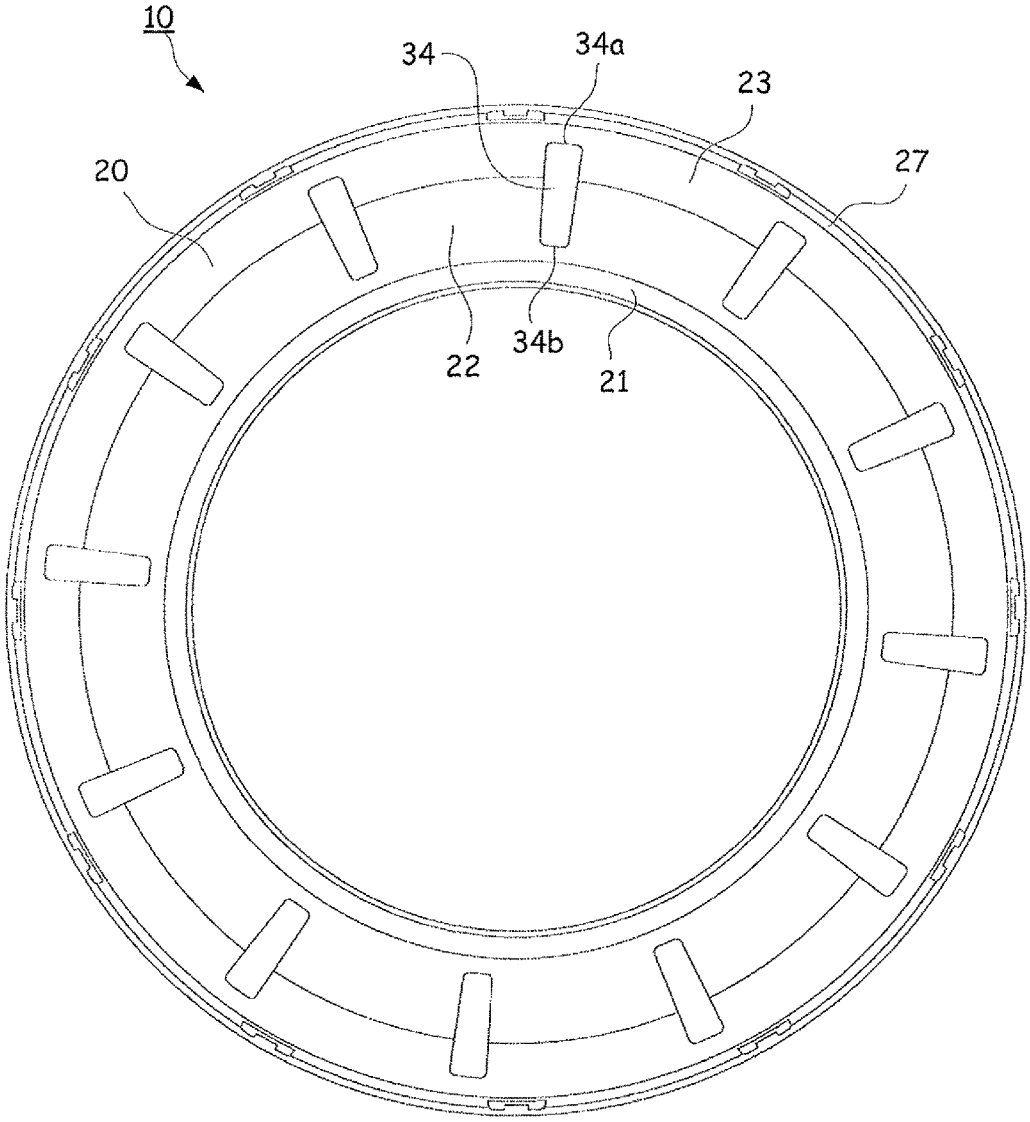
FIG. 16 shows a bottom view of the annular body and apertures in the cassette.

FIG. 14 shows a pair of cassettes 10*a*, 10*b* stacked, one on top of the other. As shown in FIG. 15 (the exploded A-A section in FIG. 14), the concentric top lip or rim 44 facilitates in the stacking of the various cassettes 10*a*, 10*b* on top of each other. As shown in FIGS. 9-10 and 14-15, an upper surface 42*a* of the ledge 42 is constructed in a substantially horizontal configuration. The upper surface 42*a* of the ledge 42 is strong enough to hold the weight of various cassettes stacked on top of each other, such as the two stacked cassettes 10*a*, 10*b* and/or more.

FIGS. 14-15 further illustrate the outer circumference of the lower edge 24*a* of the outer wall 24 being dimensioned to fit within an inner circumference surface edge 44*a* of the concentric top rim 44. As shown in FIG. 14, the second cassette 10*b* may be stacked on top of a lower first cassette 10*a* in a secure manner. That is, the lower edge 24*a* of the outer wall 24 is dimensioned to be held securely in place by the inner diameter of the inner surface edge 44*a* of the raised concentric top rim 44. This construction prevents the stacked second cassette 10*b* from sliding off of a top surface 42*a* of the ledge 42 of the annular cover 40 of the lower cassette 10*a* as it sits on an upper side of the lower annular cover 40 of the lower cassette 10*a*.

Referring back to FIG. 6 in more detail. In construction, the tubing 50 is tightly bunched into the U shaped channel of the cassette 10 between the inner wall 21, the angled wall 22, the bottom wall 23 and the outer wall 24 into a compressed mass or tubing pack 52 of profusely and tightly pleated layered tubing 50. The tubing 50 may be for example, a high density polyethylene tubing and/or any other suitable material composition in accordance with the subject disclosure. After the flexible tubing 50 has been packed 52 into the U-shaped casing of the lower annular body 20, the annular cover 40 is placed over the pleated pack 52 of tubing 50.

When the annular cover 40 is mounted and recessed onto the annular body 20, as shown in FIGS. 6 and 9-12, the packed tubing 52 bunched into the lower annular body 20 is slightly compressed until the end of the annular lip 46*a* of the annular V-shaped groove 46 slides past the lower edges 30*a* of the protruding tongues 30. The annular cover 40 is then released and allowed to retract back upward so that an annular lip 46*a* of the annular V-shaped groove 46 can lockingly engage with the downturned edges 30*a* of the protruding tongues 30 as shown in FIGS. 9 and 11-12. The annular cover 40 and the lower annular body 20 are lockingly engaged to one another by means of the cooperation of the series of tongues 30 having a size and shape adapted to snap into engagement onto the annular lip 46*a* of the V-shaped groove 46.

As shown in FIG. 9, an inner cylindrical surface 47 of the outer wall 41 of the annular cover 40 is constructed to have substantially the same diameter dimension as the inner cylindrical surface 32 of the outer wall 24 of the annular body 20. Providing substantially similar dimensions between the inner cylindrical surface 47 of the cylindrical outer wall 41 and the inner cylindrical surface 32 of the outer wall 24 will prevent the packed tubing 52 from being pinched, snagged or torn during the packing assembly and/or use when the packed tubing 52 is unraveled and the tubing 50 is drawn from within the cassette 10.

FIGS. 16-17, 1-2 and 5 illustrate the plurality of apertures 34 disposed in a radial configuration in the lower end of the annular body 20. As shown, the apertures 34 may be elongated, radially extending inwardly lengthwise from a first end 34*a* disposed in the bottom wall 23, to a second end 34*b* inwardly extending adjacent to the intersection of the angular wall 22 and the inner wall 21. The apertures 34 may be cut into the angular wall 22 and the bottom wall 23 and disposed concentrically about in a radial pattern.

The apertures 34 provide various advantages. First, during installation of the air-tight packing of the flexible packed tubing 52 into the U-shaped lower annular body 20, the various apertures 34 serve as vent holes allowing air trapped below the packed tubing 52 to vent out of the lower annular body 20 through the apertures 34 as shown in FIG. 5. The venting provided by the various apertures 34 allow the packed tubing 52 to be compressed tightly as a pleated mass within the U-shaped lower annular body 20 without air interfering with the volume within the lower annular body 20 that could otherwise be filled by the packed tubing 52. As a result, no air is trapped below the packed tubing 52 thereby allowing a tighter pack to be obtained so that more of the flexible tubing 50 in the compressed packed tubing 52 state can be stored within the lower annular body 20 during assembly of the tubing 50 into the cassette 10.

As shown in the cross section view of FIGS. 5 and 6, the contour of the angular wall 22 and apertures 34 angularly rise upward from a first end 34*a* to an elevated second end 34*b* above the flat surface of the bottom wall 23. In use, and as shown in FIG. 5, the bottom wall 23 of the cassette 10 can be placed on top of a lower surface 202. The upward angular wall 22 is lifted therefrom to promote the open venting of air that becomes trapped below the packed tubing 50 and the lower walls 23, 22 of the U-shaped lower annular body 20.

As shown in FIG. 5, the angular wall 22 encourages the escape of air through the apertures 34 from within the lower end of the U shaped channel of the lower annular body 20. It would otherwise be difficult for air to escape through the apertures 34 in the bottom wall 23 lying against the flat lower surface 202 of the support member 200, or the like. The angular wall 22 promotes the efficient and rapid packing of the tubing pack 52 into the lower annular body 20, while reducing air blockage between the surface 202 and a covered aperture 34 in the lower wall 23. It is understood that an aperture 34 may be constructed into any one, or more, of the various walls 21, 22, 23, 24, or the like.

Another significant advantage to the apertures 34 is the ability to control the rotation of the cassette 10 as shown in FIG. 5. The apertures 34 may function as key holes into which a mating key 60 of a rotation mechanism 62 can be used to control the rotation of the cassette 10 during operation of a unit (such as a waste receptacle) into which the cassette 10 may be placed and used. That is, a key 60 may be aligned to mate with at least one of the apertures 34. The key 60 may engage any portion of the aperture 34 on any wall 21, 22, 23, 24 surface and cause the cassette 10 to rotate, or prevent the cassette 10 from rotating by arresting the movement of the cassette 10.

Also shown in FIG. 5, it is to be understood that the construction for the openings 33 disposed around the tongues 30 on the upper end of the lower annular body 20 may also function as key holes into which a mating key 61 of a rotation mechanism 62 may be attached to control the rotation of the cassette according to this subject disclosure. The key 61 of the rotation mechanism 62 may be engaged with any of the various surfaces of the openings 33 to grip the cassette 10 and cause the cassette 10 to rotate or prevent it from rotating.

The apertures 34, openings 33, protruding tongues 30, the shelf itself created by the outward flared angular wall 25, the expanded outer wall 26 and the like, can all be used for various purposes, such as to grab onto the cassette 10 and secure it in a preferred position. Likewise, these various features can be used to position the cassette 10 at a predetermined height in addition to functioning as various key holes and/or contours into which a mating key 60, 61 or shape of a rotational mechanism 62 can be engaged to cause the cassette 10 to rotate or prevent the cassette 10 from rotating.

Likewise, various collars (not shown) can be constructed and adapted to fit around, and/or be integrated with a portion of the cassette 10, which will function as an extension to allow the cassette 10 to be retrofitted into a variety of different units (such as various diaper pails) of various sizes and shapes. The collar may leverage the use of the openings 33 surrounding the tongues 30, the outward flared angular wall 25, the apertures 34 and/or any other contour in order to secure a firm grasp there onto or fasten to the cassette 10 and provide an extension capable of making the cassette design universally adaptable for a variety of different units.

The positioning of the height of the cassette 10 disposed within the unit (such as a waste disposal unit) into which the cassette 10 is placed may be varied by as plurality of different parameters. The various parameters, may include, but are not limited to: lengthening or shortening the height of the outer wall 24; the position where the outward flared angular wall 25 meets the outer wall 24; the length, height and angle of the outward flared angular wall 25; the length of the expanded outer wall 26; and/or the length, height and angle of the angular wall 22 and the inner wall 21. A plurality of various other design parameters may also be manipulated to vary the height positioning of the cassette 10 in the unit it is to be used therewith.

Although the apertures 34 are shown as equidistant symmetric elongated rectangular slots extending across the angular wall 22 and the inner wall 21, it is possible to vary the number of apertures 34, their placement, the size and/or shape of the various apertures 34 to any number, size, symmetry or shape according to this subject disclosure. Likewise, is it also possible to extend the aperture 34 into the outer wall 24, or alternatively provide the apertures 34 on any one, or more, of the inner wall 21, the angular wall 22, the bottom wall 23 or the outer wall 24.

FIG. 6 depicts the cassette 10 in cross section with the flexible tubing 50 being drawn from within the U-shaped lower annular body 20. In use, the cassette 10 may be mounted to a support 200 in a device or unit (as shown in FIG. 5), such as a waste container. The flexible tubing 50 may be first retrieved from within the U-shaped lower annular body 20 through an opening 48 defined between a peripheral edge 49 of the inwardly extending ledge 42 of cover 40 and pulled the outer smooth upper edge 29 of the inner wall 21 of the body 20.

A knot may be made close to the initially pulled end of the flexible tubing 50 to tie off one end. The knotted end of the flexible tubing 50 may then be pulled or pushed (if the end of the tubing is first closed) through the central cylindrical core 27 opening. The flexible tubing 50 is withdrawn from the pack tubing 52 in the U-shaped lower annular body 20 through the opening 48 defined between the peripheral edge 49 and the central cylindrical core 27 opening, and then over the smooth top edge 29 of the central cylindrical core 27 opening wall. The tubing 50 may then be pulled down through the central cylindrical core 27 of the cassette 10.

An item of waste may be placed in the flexible tubing 50 which may then be twisted to seal and enclose the waste and its odor therein. The twisting can be done manually or by other rotational mechanism (such as described by element 62 in FIG. 5) which may be used in combination with various features of the cassette 20. Various methods for closing off the opening of the flexible bag 50 may be employed by a variety of different containers units adapted for use with the cassette 10.

As shown in exploded view in FIG. 9, the top edge 29 of the central cylindrical core 27 may be slightly expanded. The upper end of the top edge 29 expanded portion may be flat or a curved edge (as shown) to prevent damage to the tubing 50 as the tubing 50 is passed thereover. The top edge 29 of the central cylindrical core 27 opening may be made of a material having a low coefficient of friction that promotes the smooth sliding interaction of the tubing 50 over the top edge 29 of the central cylindrical core 27. Likewise, the tubing itself may be constructed of a material having a low coefficient of friction property.

As the flexible tubing 50 is withdrawn from container, the packed tubing 52 shrinks downwards in the U-shaped lower annular body 20 from the elevated packed position shown in FIG. 6. To prevent the annular cover 40 from dropping below the upper end of the annular body 20 and becoming wedged in the lower casing of the lower annular body 20 and/or inhibiting the free flow of the packed tubing 52 outward from the lower annular body 20, the concentric outward flared angular wall 25 is formed in the lower annular body 20 between the outer wall 24 and the expanded outer wall 26 and acts as a vertical stop to prevent the lower end 45 of the annular cover 40 from falling lower than the height of the angular wall 25.

The protruding tongues 30 may be formed at any point in the process. They may be created before or after the flexible tubing 50 is filled into the lower annular body 20. After the flexible tubing 50 has been packed into the lower annular body 20 as packed tubing 52, the annular cover 40 may then be placed over, and pushed into the U-shaped lower annular body 20 (as shown in FIG. 11) with sufficient force to cause the annular V-shaped groove 45 to snap past the ends 30*a* of the protruding tongues 30 which will then take up positions to prevent the annular cover 40 from rising off of the U-shaped annular body 20 as shown in FIGS. 9 and 12.

It is to be understood that various modifications to the cassettes 10, 10*a*, 10*b* described above may be made without departing from the scope of the following claims. For example, instead of employing the use of an annular V-shaped groove in the annular cover 40 that matingly interlocks with a protruding tongue 30 in the expanded outer wall 26, small dimples, shallow protuberances and/or even shallow embossed grooves may be integrated in the respective mating parts to form a secure connection between the annular cover 40 and the lower annular body 20. For example, thermoplastic body dimples (not shown) may be formed on an inner surface 28 of the expanded outer wall 26 casing (by the external application of hot points, or the like) to engage a circumferential groove disposed on the outside wall of the cylindrical outer wall 41 of the annular cover 40. Various alternatives are envisioned according to the subject matter of this disclosure. Any suitable configuration is to be understood, such as reversing the position of the circumferential groove and dimples in their respective positions, and/or like similar construction.

The flexible tubing 50 may be made in a variety of different sizes and shapes. For example, the flexible tubing 50 may be constructed of approximately 3 to 9 inches in diameter. Likewise, the diameter of the central cylindrical core 27 may be configured in various sizes and shapes, such as for example, approximately 3 inches.

Referring back to FIG. 5, the central cylindrical core 27 may be a continuous equidistant diameter or may be angled so that one end 27*a* is larger than the other end 27*b* of the central cylindrical core 27. FIGS. 5 and 6 demonstrate an example of the upper end 27*a* of the central cylindrical core 27 having a smaller diameter, and the lower end 27*b* of the central cylindrical core 27 having a larger overall diameter.

The size and shape of the cassette 10 may take any suitable size and/or shape, such as oval, rectangular, and/or any other suitable size or shape according to this subject disclosure. The figures shown are merely exemplary and a wider range of sizes is possible according to this subject disclosure.

The lower annular body 20 or cover 40 of the cassette 10 may be composed of a variety of suitable materials according to the subject disclosure. For example, the various parts may be made of a rigid plastic material, such as poly polypropylene and/or any other suitable material capable of forming a secure snap fit connection to one another. The flexible tubing 50 may be formed of a barrier film capable of sealing and reducing the odors of the waste material within the flexible tubing 50 in accordance with this disclosure.

FIG. 17 illustrates a cross section view of an alternative angular wall 22*a* configuration of the annular body 20 of the cassette 10. The angular wall 22*a* may take a variety of different configurations. As shown, the angular wall 22*a* is attached between the outer wall 24 and the inner wall 21 to form the lower inclined surface of the u-shaped channel in the lower annular body 20. The angular wall 22*a* is angled upwardly and extends from the lower end of the outer wall 24 ascending to the lower end of the inner wall 21.

A plurality of apertures 34 are provided in the angular wall 22*a*. As before, the apertures 34 are elongated, radially extending lengthwise in the angular wall 22*a* from a first end 34*a* disposed adjacent to the outer wall 24 to a second end 34*b* disposed adjacent to the inner wall 21. The apertures 34 are cut into, and disposed concentric about, the angular wall 22*a* in a radial pattern.

The contour of the angular wall 22*a* and apertures 34 rise angularly upward from the first end 34*a* to the second end 34*b* above a flat lower surface (such as the support surface 202 shown in FIG. 5) that the cassette 10 may be place thereon. The ascending configuration of the angular wall 22*a* is beneficial in allowing air trapped below the packed tubing 52 and above the lower annular wall 22*a* to vent outward into the surrounding atmosphere from within the lower annular body 20.

FIG. 18 depicts yet another cross section view of an angular wall 22*b* configuration for the lower annular body 20 of the cassette 10. As shown, the angular wall 22*b* descends at a downward angle between the lower end of outer wall 24 and the lower end of the inner wall 21 to form the lower angular surface of the U-shaped channel in the lower annular body 20.

Likewise, a plurality of apertures 34 are provided in the angular wall 22*b* for venting and rotational control. As before, the apertures 34 are elongated, radially extending lengthwise in the angular wall 22*b* from a first end 34*a* disposed adjacent to the outer wall 24, descending to a second end 34*b* disposed adjacent to the inner wall 21. The apertures 34 are cut into, and disposed concentric about, the angular wall 22*b* in a radial pattern.

The contour of the angular wall 22*b* and apertures 34 angularly descend downward from the first end 34*a* to the second end 34*b*, and above a flat lower surface (such as the support surface 202 shown in FIG. 5) that the cassette 10 may be place thereon. The benefit of this configuration is to vent air trapped below the packed tubing 52 and above the lower annular wall 22*b* inside of the U-shaped lower annular body 20 outward into the surrounding atmosphere.

Figure 19:
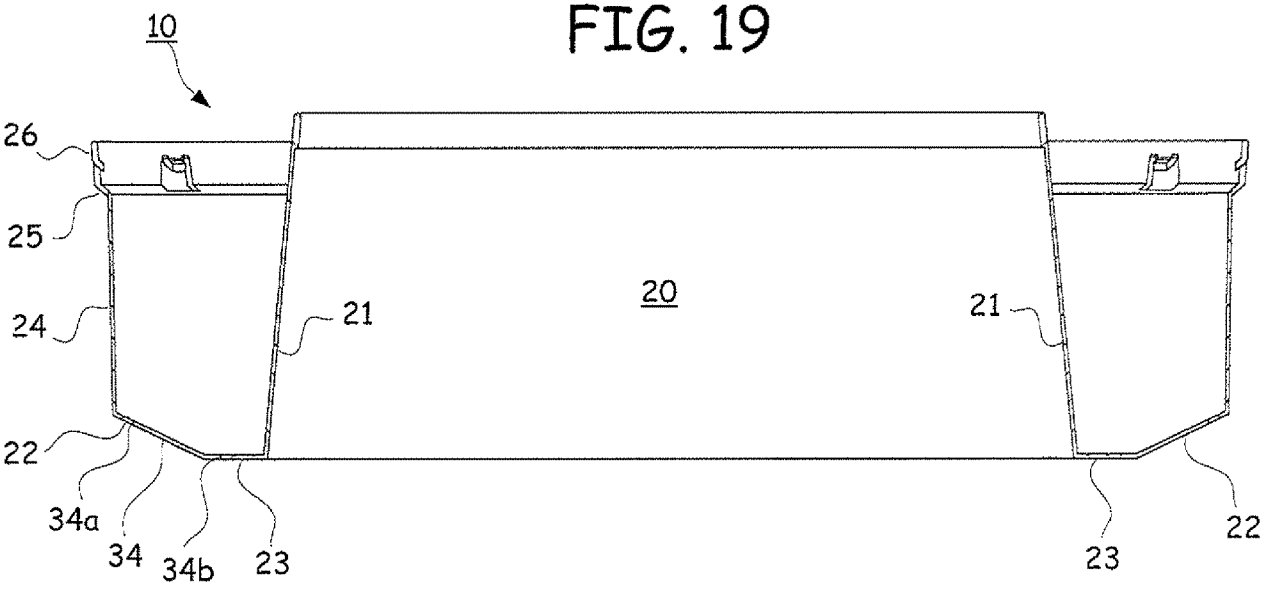
FIG. 19 shows another alternative side cross section view of the bottom wall and angular wall configuration of the annular body of the cassette.

FIG. 19 illustrates another exemplary cross section view for a cassette 10 in which a bottom wall 23 is disposed adjacent to the inner wall 21. Likewise, the angular wall 22 is constructed between the lower end of the outer wall 24 and the lower end of the bottom wall 23 to form the lower angular surface of the u-shaped channel in the lower annular body 20. As shown, the angular wall 22 is angled, descending downwardly from the outer wall 24 to the bottom wall 23.

A plurality of apertures 34 are provided in the angular wall 22. As before, the apertures 34 are elongated, radially extending lengthwise from within the angular wall 22 and into the bottom wall 23. A first end 34*a* of the aperture 34 is disposed in the angular wall 22 adjacent to the lower end of outer wall 24 and extends into the bottom wall 23. The apertures 34 are cut into, and disposed concentric about, the angular wall 22 and the bottom wall 23 in a radial pattern.

The contour of the angular wall 22 and apertures 34 is beneficial in allowing air trapped below the packed tubing 52 and above the lower annular wall 22 of the U-shaped lower annular body 20 to vent outward from within the lower annular body 20 into the surrounding atmosphere through the apertures 34 during assembly of the packed tubing 52.

Figure 20:
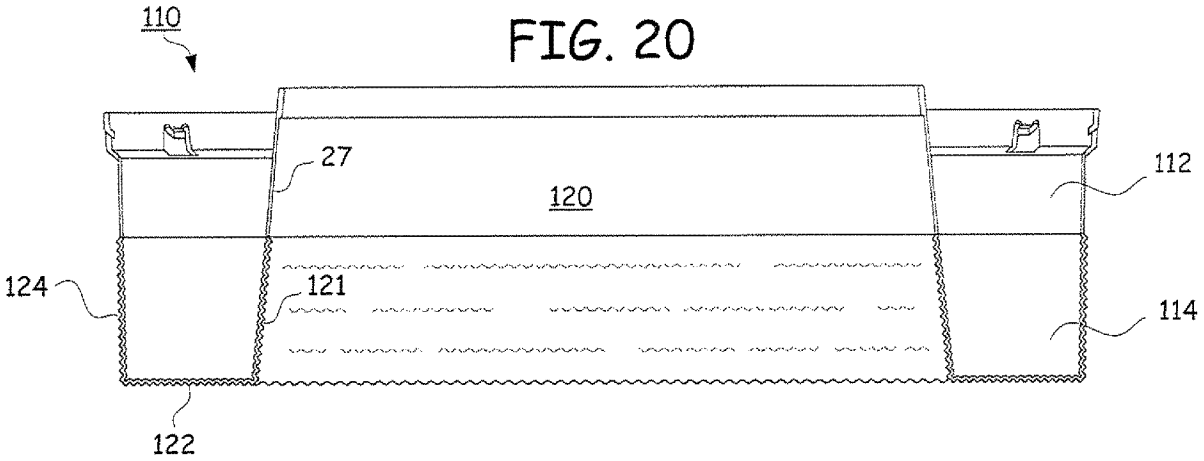
FIG. 20 illustrates a cross section view of a compressible cassette including a flexible lower annular base.

FIG. 20 illustrates a cross section view of a compressible cassette 110 including a flexible lower annular base 114 integrated into the lower portion of the annular body 120. The flexible lower annular base 114 is pliable and universally adaptable to be bent and/or molded into the shape of a variety of different obtuse lower and surrounding surfaces.

Figure 21:
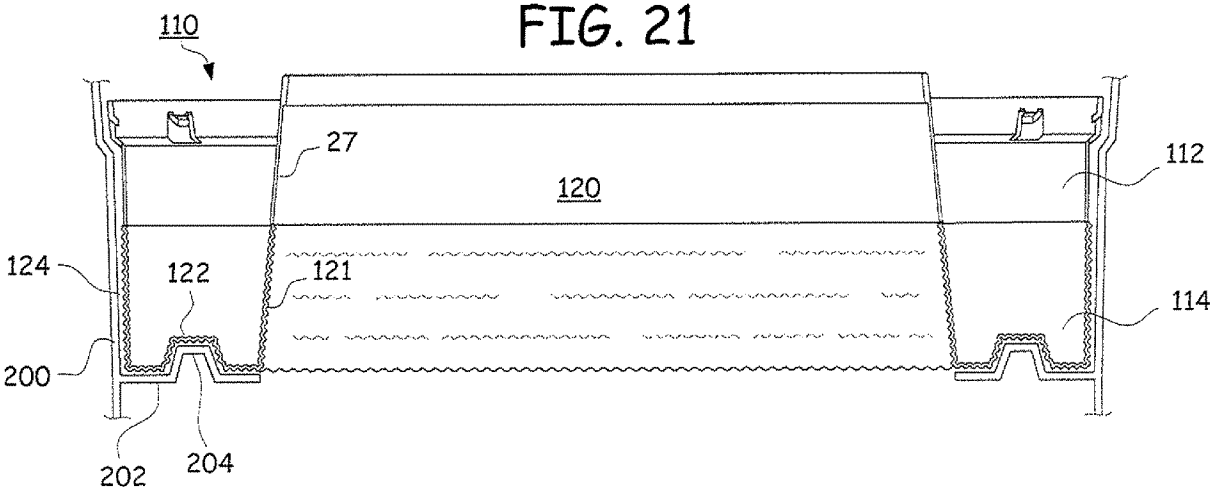
FIG. 21 depicts the cross section view of the flexible lower annular base pliably conforming to an obtuse surface.

The flexible lower annular base 114 may be composed of one or more flexible materials. For example, the annular body 120 may be composed of two portions as shown in FIGS. 20-21. An upper end 112 of the annular body 120 may be composed of a first material, and the lower annular base 114 of the annular body 120 may be composed of a second material.

The first material at the upper end 112 of the annular body 120 may be made of a rigid material as described above capable of securing the annular cover 40 to the tongues 30 in the upper end of the annular body 120.

The second material at the lower end 114 of the annular body 120 may be made of a more flexible material capable of being compressed into the various obtuse shapes and surfaces. Although described as two materials, the cassette 110 may be composed of a single material having pliable properties flexible enough to be compressed and molded into a variety of different sizes and shapes.

FIG. 21, for example, illustrates the cassette 110 being held by a support member 200 in use in a unit (such as a waste disposal unit). The support member 200 provides an extended surface 202 onto which the lower end 114 of the U-shaped annular body 120 may be supported. As shown in FIG. 21, the lower end 114 of the annular base 120 may be compressed onto the surface 202 having an obtuse shaped protrusion 204 disposed thereon. As shown, the lower end 114 of the annular body 120 is pliably compressed over the protrusion 204 so that the lower end 114 of the annular body 120 contours over and around the upward extending protrusion 204.

As shown in one example, the advantage of providing a compressible lower end 114 is to allow the cassette 110 to be pliably adapted to conform to a variety of different sizes and shapes. Although the obtuse protrusion 204 is shown adjacent to the lower surface 202 of the annular body 120, it is also to be understood that any obtuse shape may be present on any surface surrounding the cassette 110. As such, the compressible cassette 110 may be pliably adapted to conform to any shape about any side and for use therefore. By way of example, the obtuse surface shape may be located adjacent to the side outer wall 124, the lower wall 122, the inner wall 121 and/or any other surface on the compressible cassette 110.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

What is claimed:

1. A method of engaging a cassette that dispenses a pleated tubing, comprising:

providing an annular body having a generally U shaped housing with a central cylindrical core;

securing and extending an annular cover over the annular body defining a gap between the annular body and the annular cover;

engaging at least one of a plurality of apertures provided in an angular wall in the annular body, the angular wall being concentric around the body; and controlling the angular rotation of the cassette via mating a keying mechanism with the at least one of a plurality of apertures.

2. The method recited in claim 1, wherein the controlling step is preventing the angular rotation of the cassette.

3. The method recited in claim 1, wherein the controlling step is permitting the angular rotation of the cassette.

4. The method recited in claim 1, further comprising:

dispensing of a pleated tubing from the gap.

5. The method recited in claim 1, wherein the mating a keying mechanism further comprises:

aligning and inserting at least one projection into the at least one aperture.

6. The method recited in claim 5, wherein the aligning and inserting further comprises:

locking the at least one projection into the aperture.

7. The method recited in claim 1, wherein the mating a keying mechanism further comprises:

connecting a mating key to the cassette that connects to the at least one aperture.

8. A method of engaging a cassette that dispenses a pleated tubing, comprising:

providing an annular body having a generally U shaped housing with a central cylindrical core and at least one of a plurality of apertures in the annular body;

securing and extending an annular cover over the annular body defining a gap between the annular body and the annular cover;

engaging the at least one aperture; and controlling movement of the cassette via mating a keying mechanism with the at least one aperture.

9. The method recited in claim 8, further comprising:

allowing air to escape through the at least one aperture during packing of pleated tubing.

10. The method recited in claim 8, wherein the providing step further comprises:

radially extending the at least one aperture in a concentric wall in the annular body.

11. The method recited in claim 8, wherein the controlling step is preventing the rotation of the cassette.

12. The method recited in claim 8, wherein the controlling step is rotating the cassette.

13. The method recited in claim 8, wherein the providing step further comprises:

recessing the at least one aperture into an outward flared angular wall of the annular body.

14. The method recited in claim 8, wherein the providing step further comprises:

recessing the aperture into an expanded outer wall of the annular body.

15. A method of engaging a cassette that dispenses a pleated tubing, comprising:

providing an annular body having a generally U shaped housing with a central cylindrical core and at least one of a plurality of apertures in the annular body;

securing and extending an annular cover over the annular body defining a gap between the annular body and the annular cover;

aligning and inserting at least one projection into the at least one aperture in the annular body; and controlling movement of the cassette via the at least one aperture.

16. The method recited in claim 15, wherein the controlling step is permitting or preventing the rotation of the cassette.

17. The method recited in claim 15, wherein the providing step further comprises:

providing an angular wall in the annular body that is concentric and frustoconically flat around the annular body.

18. The method recited in claim 15, wherein the providing step further comprises:

recessing the at least one aperture into an outward flared angular wall of the angular body.

19. The method recited in claim 15, wherein the providing step further comprises:

recessing the aperture into an expanded outer wall of the angular body.

* * * * *